US005370020A

United States Patent [19]

Fifield et al.

[11] Patent Number: 5,370,020

[45] Date of Patent: Dec. 6, 1994

[54] NAIL HOLDER

[76] Inventors: John T. Fifield; Sandi H. Fifield, both of 19 Crawford Rd., Westport, Conn. 06880

[21] Appl. No.: 83,628

[22] Filed: Jun. 28, 1993

[51] Int. Cl.[5] ..... B25C 3/00

[52] U.S. Cl. ..... 81/44; 294/99.2; D28/55

[58] Field of Search ..... 81/44; 294/99.1, 99.2, 294/3; D7/686; D28/55

[56] References Cited

U.S. PATENT DOCUMENTS

| | | | |
|---|---|---|---|
| 1,062,464 | 5/1913 | Haynes . | |
| 1,426,249 | 8/1922 | Bochonok . | |
| 2,563,677 | 8/1951 | Frazier . | |
| 3,071,893 | 1/1963 | Schwartz . | |
| 3,306,139 | 2/1967 | Brackett | 294/99.2 |
| 3,316,949 | 5/1967 | Canfield . | |
| 3,522,827 | 8/1970 | Muller . | |
| 4,079,764 | 3/1978 | Hayes . | |
| 4,201,258 | 5/1980 | Elmore et al. . | |

FOREIGN PATENT DOCUMENTS

| | | | |
|---|---|---|---|
| 73207 | 3/1948 | Norway | 294/99.2 |

*Primary Examiner*—James G. Smith
*Attorney, Agent, or Firm*—Brumbaugh, Graves, Donohue & Raymond

[57] ABSTRACT

A novelty holder for nails, brads and the like incudes a pliable molded sculpted hand having the shape and appearance of a human hand as it would be oriented if holding a nail between the thumb and forefinger perpendicularly to a workpiece. A spring integrally molded within the thumb and forefinger normally biases the tips of the thumb and forefinger into contact with each other whereby a nail is resiliently received in firm and guided relation between the thumb and forefinger. The underside of the sculpted hand is flat so that the holder may be stably seated upon a workpiece. An optional sound device supported within the sculpted hand is adapted to say "ouch" when a part of the hand, say the thumb, is struck with predetermined impact.

8 Claims, 1 Drawing Sheet

NAIL HOLDER

BACKGROUND OF THE INVENTION

This invention relates to holders for nails, brads and the like and, more particularly, to a novelty nail holder that is both utilitarian and amusing.

Holders for nails and brads have been known and used for many years to avoid injury to a person's fingers when driving nails of short length or in cramped quarters. Such devices date back for more than a century, as represented by Canfield 3,316,949, Frazier 2,563,677, Muller 3,522,827 and Elmore et al 4,201,258, which patents by their dates show that the holding of nails to start them is a long standing and continuing problem.

Such nail holding devices desirably should be relatively inexpensive and be able to withstand the impacts likely to occur should the person wielding the hammer miss the head of the nail and strike the holder itself, particularly when working from the side or in close quarters. Moreover, the device should provide for stable seating of the nail or brad in a perpendicular position with respect to a workpiece without requiring the user to provide support or stability thereto except to limit possible movement from an initially determined position.

The nail holder described in Muller 3,522,827 consists of a reversely bent strip of resilient material having a widened bight and two legs urged convergently into contact with each other. The free end portions of the legs are bent conjointly at right angles in nesting relationship, whereby a nail, regardless of size, can be slipped in place between the nested end portions and supported in an upright position to receive starting blows of a hammer. Thereafter, the nail is readily released from between the already spaced apart end portions by pulling the holder away from the nail.

Elmore et al describe in U.S. Pat. No. 4,201,258 a nail holder which includes a pair of operating members each having an elongated jaw portion, a handle portion and a pivot portion intermediate the jaw and handle portions normally biasing the jaw portions into engagement with each other. The handle portions are moveable towards each other to open the jaws against the biasing pressure of the pivot to permit insertion of a nail therebetween to be held with its head projecting upwardly to facilitate striking by a hammer. The bottom faces of the jaw portions lie in a common plane with the lowest surfaces of the handle portions so that the holder can be stably seated upon a workpiece into which the nail is to be driven and to orient a nail held between the jaws perpendicularly to the work surface.

It is an object of the present invention to provide a nail holder of novel configuration which is of simple and durable construction and which is adapted to firmly retain nails and brads in perpendicular relationship to a workpiece.

It is also an object to provide such a nail holder which has the shape and appearance of a human hand as it would be oriented to hold a nail in position to be struck by a hammer.

Another object is to provide such a handsimulative nail holder which may be economically fabricated primarily from pliable plastics material.

Still another object is to provide such a handsimulative nail holder which is adapted to emit a painindicating sound should the person wielding the hammer miss the head of the nail or brad and strike the "thumb" of the simulated hand.

A general object of the invention is to provide a nail holder which is adapted to firmly retain nails or brads in a position to be struck by a hammer and thus serve a utilitarian purpose while at the same time being a source of amusement.

SUMMARY OF THE INVENTION

Briefly, the nail holder according to the invention comprises a sculpted hand molded from a pliable material having the shape and appearance of a human hand as it would be oriented if holding a nail between the thumb and forefinger in a position perpendicular to a workpiece. A spring metal clamp embedded in the thumb and forefinger of the sculpted hand normally biases the tips of the thumb and forefinger into contact with each other, with no space normally between them, whereby a nail, regardless of size, is resiliently received in firm and guided relation between the thumb and forefinger. The nail may be additionally held in place by a pair of V-shaped grooves formed in the thumb and forefinger at the point at which they contact each other. The underside of the sculpted hand is flat so that the holder may be stably seated upon a work surface, and is oriented perpendicularly to the nail holding grooves. The amusement quality of the holder may be enhanced by incorporating in the thumb or forefinger a battery-powered sound-producing device designed to say "ouch" when the "thumb" is struck with sufficient impact.

BRIEF DESCRIPTION OF THE DRAWINGS

Other objects, features and advantages of the invention will become apparent, and its construction and operation better understood, from the following detailed description read in conjunction with the accompanying drawings, in which.

DESCRIPTION OF THE PREFERRED EMBODIMENT

Figure 3:
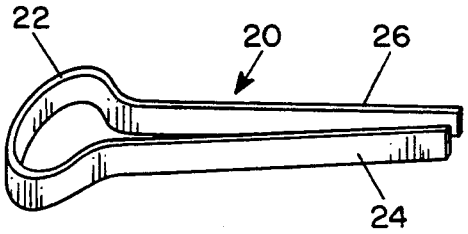
FIG. 3 is a perspective view of one embodiment of spring for biasing the thumb and forefinger of the sculpted hand into contact with each other.

Referring now to the drawings in detail, the nail holder 10 for a nail 12 is in the shape of a sculpted hand 14 molded from a pliable material such as plastic or rubber. The sculpted hand has a flat underside which when placed on a flat surface, such as a workpiece into which a nail is to be driven, positions the thumb 16 and forefinger 18 of the hand in much the same way that corresponding digits of a person's hand are oriented when holding a nail between thumb and forefinger in an upright position preparatory to striking it with a hammer. A ribbon or strip 20 of flat mild spring steel, or amorphous plastic, which as shown in FIG. 3, is reversely bent in a direction transversely to its plane to provide a wide bight portion 22 and coextensive legs 24 and 26 resiliently urged toward each other, is embedded in the hand during molding. The bight 22 bridges the "V" at the base of the thumb and forefinger and the legs 24 and 26 extend substantially to the tips of the thumb and forefinger, respectively, and normally bias the tips into contact with each other, with no space normally between them, whereby a nail 12, regardless of size (within practical limits), may be resiliently received in firm and guided relation between the thumb and forefinger. The confronting inner areas of the thumb and forefinger are provided with a pair of grooves 28 and 30 oriented perpendicularly to the flat underside of the hand for holding a nail or brad vertically with respect to a workpiece on which the hand is supported.

Figure 1:
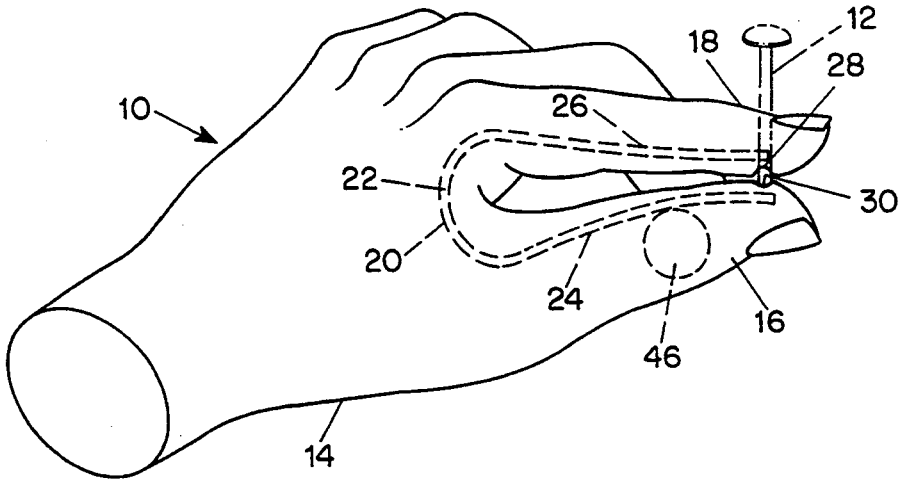
FIG. 1 is a perspective view of a nail holder constructed in accordance with the present invention.
Figure 2:
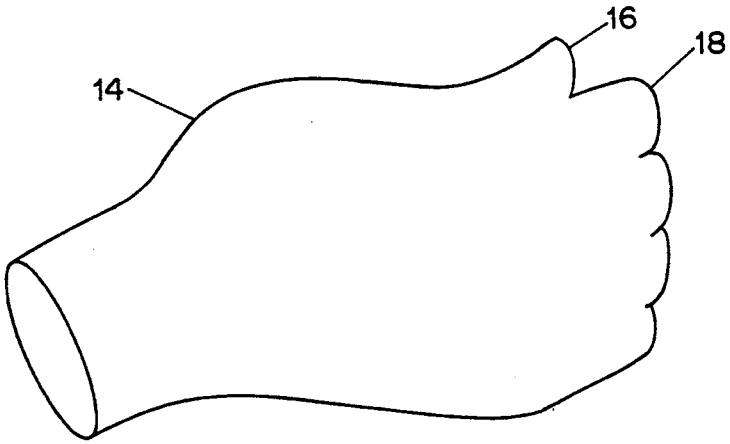
FIG. 2 is a perspective view showing the underside of the nail holder.

In operation of the FIG. 1 embodiment, a nail or brad 12 inserted in the V-shaped grooves 28 and 30 opens slightly the space between the thumb 16 and forefinger 18. The point or tip of the nail or brad 12 normally does not initially extend below the plane of the underside of the hand, but may be pressed downwardly into the workpiece, after which the holder is slid downwardly on the shank of the nail to seat stably on the workpiece. The holder is then positioned upon the workpiece (not shown) so as to align the brad or nail 12 with the point of desired entry into the workpiece. A hammer (not shown) is then used to strike the head of the nail or brad and drive it into the workpiece sufficiently to stably orient it in the perpendicular position. The holder may then be removed, and the nail or brad driven fully into the workpiece.

Figure 4:
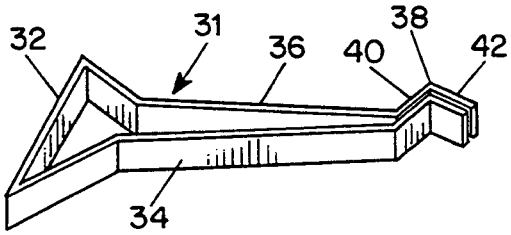
FIG. 4 is a perspective view of second embodiment of a spring for biasing the thumb and forefinger into contact.
Figure 5:
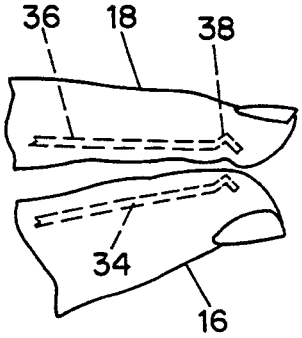
FIG. 5 is a fragmentary perspective view of a portion of the nail holder of FIG. 1 in which the spring of FIG. 4 is incorporated.

In an alternative embodiment of the nail holder, the spring for biasing the thumb and forefinger into contact with each other is generally similar to the resilient device described in the aforementioned U.S. Pat. No. 3,522,827 and illustrated in FIGS. 4 and 5. The spring is constructed of a ribbon or strip 31 of flat mild spring steel, or amorphous plastic, which is reversely bent in a direction transversely to its plane to provide a wide bight portion 32, sufficiently wide to bridge the "V" at the base of the thumb and forefinger of the sculpted hand, and legs 34 and 36 resiliently urged toward each other. At their contacting ends, the legs are die-formed to define nesting angle off-sets each having a sharp included corner apex at 38 between straight entrant sides of each leg, particularly the included corner apex between the straight entrant side 40 and exit or terminal side 42. The angle at the corner apex 38 is preferably 90° as shown.

The described spring device is embedded in the thumb and forefinger during molding of the hand 14 with the bight 32 bridging the "V" formed at the base of the thumb and forefinger and the legs 34 and 36 extending interiorly toward the tips of the thumb and forefinger, respectively. The contacting ends of the legs 34 and 36 of the spring are disposed near the tips of the thumb and forefinger, respectively, with their respective corner apexes 38 projecting slightly from the molded material so as to be exposed, and oriented perpendicularly to the flat underside of the sculpted hand. In use, the shank of a nail or brad 12 is simply slipped into the vertically-oriented apex 38 of the contacting ends of legs 34 and 36 to receive starting blows of a hammer, and thereafter the holder is removed from the started nail to permit its being fully driven into the workpiece.

The amusement value of the nail holder may be enhanced, without detracting from its nail-holding utility, by further simulation of the human nail-driving experience of occasionally striking the fingers instead of, or in addition to, the nail. To this end, a sound-producing device 46 adapted to generate an audible sound in response to a hammer blow of predetermined impact, may be installed within either the thumb or forefinger of the sculpted hand 14 near the tip so as to be in proximity to a held nail. As the thumb is probably the most frequent victim of errant nail-starting hammer blows, the sound source is preferably disposed within the thumb just behind the thumb nail. It may be of the kind in current widespread use on greeting cards, for example, namely, a battery-powered microchip which generates an audible message in response to finger touch. The sound source may be molded into pliable thumb material, or preferably, is contained in a shallow cavity formed in the inner side of the thumb 16 which allows removal for changing the battery. The circuit may be programmed to emit a pre-selected sound, such a "ouch", in response to the tip of the thumb being struck with a predetermined impact.

The nail holder may be molded in several sizes, and may be made to simulate the hand of both sexes, which may be distinguished by colored finger nails for the woman, for example and/or the shape and size of the fingers. Also, the hand may be colored to represent different races, either by choice of molding material or application of paint.

The nail holder is intended to be an item that one might buy both as a gag gift and as a useful tool for the less than adept craftsman.

As will be appreciated, it is highly advantageous to fabricate the holder as a one-piece structure with embedded spring means from synthetic resins by injection molding. To ensure long life, the resin selected should be one having a substantial degree of resistance to impacts while at the same time being sufficiently pliable that the thumb and forefinger can be flexed sufficiently to receive a nail or brad therebetween.

Thus, it can be seen from the foregoing description and the attached drawing that the nail holder of the present invention is of simple but durable construction and, while possessing an amusement quality, is adapted to firmly retain nails, brads and the like in a perpendicular relationship to the underlying workpiece. The nail holder may be economically fabricated and may include a device for emitting a sound indicative of pain should the "fingers" of the holder be struck.

We claim:

1. A holder for nails and the like comprising:

a sculpted hand formed of pliable material having the shape and appearance of a human hand as it would be oriented if holding a nail between the thumb and forefinger perpendicularly to an underlying workpiece; and means associated with the thumb and forefinger of said sculpted hand normally biasing the tips of the thumb and forefinger of said sculpted hand into contact with each other, with no space normally between them, the contacting surfaces of said thumb and forefinger being adapted to retain a nail or the like therebetween with the head thereof projecting upwardly to facilitate striking of the associated nail with a hammer or the like, the contacting surface of either the thumb or the forefinger of said sculpted hand having a vertically extending groove therein adapted to receive a nail or the like for retention therein and said sculpted hand having a flat underside in perpendicular relationship with said vertically extending groove.

2. The nail holder of claim 1, wherein the contacting surface of both the thumb and forefinger of said sculpted hand has a vertically extending groove therein adapted to receive a nail or the like for retention therein.

3. The nail holder of claim 1, wherein said biasing means comprises a strip of flat resilient material bent to form a bight and first and second legs carried by said bight and urged toward each other, and wherein the first and second legs of said strip are embedded in said thumb and said forefinger, respectively, and each terminates substantially at a point at which the thumb and forefinger of said sculpted hand contact each other.

4. The nail holder of claim 1, wherein said biasing means comprises a strip of flat resilient material bent to form a bight and first and second legs carried by said bight and urged toward each other;

wherein the first and second legs of said strip are embedded in the thumb and said forefinger, respectively, of said sculpted hand and are conjointly offset to provide angularly oriented straight side portions in nested relationship at a point at which said thumb and forefinger contact each other and defining a sharp included angle for engaging the shank of a nail or the like.

5. The nail holder of claim 1, wherein said holder further comprises a sound source supported within said sculpted hand near a point at which the thumb and forefinger contact each other and adapted to emit a painrepresentative sound in response to the thumb or forefinger of said sculpted hand being struck with predetermined impact.

6. The nail holder of claim 5, wherein said sound source is a battery-powered microchip and is supported within the thumb of said sculpted hand.

7. The nail holder of claim 3, wherein said holder further comprises a sound source supported within the thumb of said sculpted hand near a point at which its thumb and forefinger contact each other, and wherein said sound source is a microchip programmed to emit an "ouch" sound in response to the thumb of said sculpted hand being truck with predetermined impact.

8. The nail holder of claim 4, wherein said holder further comprises a sound source supported within the thumb of said sculpted hand near a point at which its thumb and forefinger contact each other, and wherein said sound source is a microchip programmed to emit an "ouch" sound in response to the thumb of said sculpted hand being struck with predetermined impact.

* * * * *

UNITED STATES PATENT AND TRADEMARK OFFICE

CERTIFICATE OF CORRECTION

PATENT NO. : 5,370,020

DATED : December 6, 1994

INVENTOR(S) : Fifield et al.

It is certified that error appears in the above-identified patent and that said Letters Patent is hereby corrected as shown below:

Col. 1, line 63, "handsimulative" should read --hand-simulative--;

Col. 1, line 66, "handsimulative" should read --hand-simulative--;

Col. 1, lines 67-68, "painindicating" should read --pain-indicating--;

Col. 4, line 17, "such a" should read --such as--;

Col. 6, line 5, "painrepresentative" should read --pain-representative--;

Col. 6, line 17, "truck" should read --struck--.

Signed and Sealed this

Twenty-eight Day of March, 1995

*Attest:*

*Attesting Officer*

BRUCE LEHMAN

*Commissioner of Patents and Trademarks*